US006478371B1

(12) United States Patent
Clarke

(10) Patent No.: US 6,478,371 B1
(45) Date of Patent: Nov. 12, 2002

(54) RETRACTABLE AND REMOVABLE CONCESSION HOLDER FOR STADIUM SEATING

(76) Inventor: Christopher Micheal Clarke, 120 Albion, Park Ridge, IL (US) 60068

( * ) Notice: Subject to any disclaimer, the term of this patent is extended or adjusted under 35 U.S.C. 154(b) by 0 days.

(21) Appl. No.: 09/398,493

(22) Filed: Sep. 17, 1999

(51) Int. Cl.[7] ..... A47C 7/62

(52) U.S. Cl. ..... 297/188.11; 297/188.12; 297/188.2

(58) Field of Search ..... 297/188.01, 188.08, 297/188.11, 188.12, 188.2; 224/275, 547, 926; 248/311.2, 224.51

(56) References Cited

U.S. PATENT DOCUMENTS

| | | | | |
|---|---|---|---|---|
| 2,210,347 | A | | 8/1940 | Story |
| 2,926,879 | A | | 3/1960 | Dietrich |
| 3,504,830 | A | | 4/1970 | Trammell, Jr. |
| 3,526,314 | A | | 9/1970 | Trammell, Jr. |
| 3,623,683 | A | | 11/1971 | Bennet |
| 4,341,418 | A | | 7/1982 | Chappell |
| 4,681,219 | A | | 7/1987 | Kitchens |
| 4,697,780 | A | * | 10/1987 | Wenkman et al. |
| 4,715,652 | A | | 12/1987 | Wards |
| 4,858,869 | A | * | 8/1989 | Stang |
| 4,861,102 | A | * | 8/1989 | Fuller |
| 5,022,626 | A | | 6/1991 | Nozel et al. |
| 5,356,107 | A | * | 10/1994 | Sinohuiz |
| 5,383,586 | A | * | 1/1995 | Leivan |
| 5,419,154 | A | * | 5/1995 | Christoff |
| 5,524,957 | A | * | 6/1996 | Gibriano |
| 5,586,806 | A | * | 12/1996 | Hergott |
| 5,746,363 | A | | 5/1998 | Teller et al. |
| 5,813,644 | A | * | 9/1998 | Bergin |
| 5,996,957 | A | * | 12/1999 | Kurtz |

* cited by examiner

*Primary Examiner*—Milton Nelson, Jr.

(57) ABSTRACT

A retractable removable concession holder affixed to permanently attached seating that is commonly found in large capacity entertainment facilities. The concession holder is comprised of a concession container displaying advertising information, a mounting bracket and a seat attachment bracket and a seat attachment portion. The concession container is removably attached to the mounting bracket which is slidingly attached to the seat attachment portion. The seat attachment portion is permanently affixed to the underside of the seat in such a fashion that the concessions container can be brought form an operating position in between the seated patron's legs to a stowed position under the seat and out of the way of patron. The operating position for the (invention) retractable removable concession holder places the concessions container in the front of the seat so that the concessions container can be detached from the mounting bracket to be replaced with another concessions container containing different advertising information or to be take as a souvenir by the patron.

15 Claims, 5 Drawing Sheets

20
23
21
22
71
26
28
25
PORTS
CTION
2
3
34
36
32
33
8
31
24
27
29
37
32
48
47
45
46
44
49
36
50
43
41
6
30
37
40

RETRACTABLE AND REMOVABLE CONCESSION HOLDER FOR STADIUM SEATING

FIELD OF THE INVENTION

The present invention relates to the field of concessions holder affixed to permanently attached seating commonly found in large capacity entertainment facilities such as stadiums, amphitheaters, sports arenas, ball parks and theaters to provide a platform for holding a patron's food and drink that can be stowed under the seating when not in use.

THE BACKGROUND OF THE INVENTION

This invention relates to seating such as chairs or benches that are commonly found in stadiums and theaters. This seating is generally found to be permanently mounted in the entertainment facility in descending rows to facilitate the organized seating of large crowds that patronize such establishments.

The stadium chair-type seating typically comprises of an individual seat with or without a back rest and a seat support which affixes the stadium chair-type seating to the structure of the facility. The stadium chair-type seating may be of a folding type in which the seat is pivotally attached to either the back rest or the seat support. This arrangement permits the seat to be lifted manually or automatically when not in use into an upright position thereby permitting ease of movement among the patronage and cleaning crews.

The bench type seating, as its names applies, is usually a fixed bench, with or without back support and can accommodate several individuals at once.

In accordance with the recent emphasis on accommodations for concessions in these facilities, the stadium seating now feature a cupholder or other type of concessions or accessory holder. These holders come in a wide variety of shapes and sizes and may be affixed to the seating by a number of different means.

Frequently, and especially in older facilities that were designed before concessions were so emphasized, concessions holders, if any, were many times located in an awkward positions. This poor positioning can produce a multitude of negative effects.

Problems resulted because the placement of these holders obstructed the already narrow lanes of passage in the aisles between the seat rows. These holders have been known to cause and can cause patron injury when patrons move among the row of seating. Tripping accidents occurred when patrons walking past the seats would hit the area of their legs between the ankle and mid-calf on holders that were located lower down on the seating near the support stanchion of the seating.

In more modern stadiums, an alternative mounting of concessions holders integrates the holder into the arm rests of the chairs. However such designs often interfere with patronage movement among the seats and can prove to be very restrictive to patrons' movements when patrons are seated. In addition, this style concessions holder may be particularly intrusive and very uncomfortable for larger or heavier patrons. Finally, this style of fixed concessions holders tends to limits the size and shape of the cups that can be held.

Beyond risk of potential injury to patrons posed by these types of immovable concession holders, the holders' exposed position subjects the holders themselves to damage whether intentional or accidental. This damage results in additional costs for having a maintenance crew to remove and then replace the damaged holder.

At present, commonly used concessions holders are non-moveable and permanently affixed to the stadium seating. Consequently, these permanently affixed concessions holders can not be moved to stowed position out of the way of the patrons using the seating or walking through the seating rows. In addition, while some of these concessions holders may have advertising printed on them, their permanency generally precludes frequent changing of displayed advertising information to match present or upcoming venues on changes in sponsorship.

The prior art has have attempted to solve some of the aforementioned problems but none have successfully addressed all of these problems.

One prior art invention addresses use of portable concessions holders for use with stadium seating, U.S. Pat. No. 4,715,652, Ward. Ward discloses a portable seat with attached cupholder for use in stadiums with bench type seating. Ward permits stadium patrons to carry into the facility their own seat and backrest which is then placed onto the top of benches thereby allowing the patron to rest their backs during a performance. The Ward patent further teaches a cup holder consisting of a tray and a circular opening is be slid out from underneath the seat. The device can not be used in stadiums featuring chair style seating and is restrictive in the types of cups and concessions that it can accommodate.

Two patents U.S. Pat. No. 3,623,683, Bennett, and U.S. Pat. No. 2,210,347, Story, address removable storage devices that can be slidingly stowed underneath the seat. Bennett '638', discloses a shallow box-like compartment that is non-permanently mounted underneath a airliner passenger seat and slides forward to clear the seat. This sliding compartment is used for the holding of life saving equipment and is not used as a tray or concessions holder. Further, the invention does not display any advertisement.

Similarly, Story, '347', discloses a tool box that is slidingly and non-permanently mounted underneath the operator's seat of farm machinery. This invention addresses under seat storage rather than a holder for concessions or a replaceable medium for advertising.

The above described art does not fully address the need for a stowable concessions holder for stadium seating that can be used as a replaceable medium for advertisement.

SUMMARY OF THE INVENTION

The subject invention relates to a stowable and removabley affixed concessions holder for stadium seating that comprises of a concessions container, a mounting bracket that holds the concessions container, and a seat attachment portion which allows the concessions container to be movably stowed underneath the seat. The concessions container is reversibly attached to the mounting bracket so as to allow easy replacement of the concessions container. The mounting bracket is movably affixed to the seat attachment portion which itself is permanently attached to the underside of the seating. This allows the presentation of the concessions container in an operating position in front of the seat between the legs of the patron. When not is use, the patron can then move the concessions container and mounting bracket along the length of the seat attachment portion to the stowage position underneath the seating.

The concessions container is constructed so that its interior can accommodate a wide variety of concessions, entertainment programs, product samples, brochures or the alike.

The container portion's exterior could contain advertising information and sponsor information as well as be made in various novelty shapes and forms limited only by the requirements for holding capacity, attachment and stowage capability. In this manner, a concessions container could be readily exchanged with a new concessions container presenting new information about an advertising sponsor or about up coming events or it could be taken by the patron as an souvenir from the event watched by the patron.

The primary object of this invention is to provide a stowable and removable concession holder for stadium seating that can be a platform for advertising as well as being easily manufactured at low cost and easily installed.

It is a further object of the present invention to provide a stowable and removable concessions holder for stadium seating that can be inexpensively, and quickly mass produced.

It is a further object of the present invention to provide a stowable and removable concessions holder for stadium seating that can be quickly and easily be affixed to stadium seating.

It is a further object of the present invention to provide a concessions holder that can be stowed out of the way of the patron that is using the seat or that is walking past the front of the seat.

It is a further object of the present invention to provide a concessions holder that can be stowed so as to reduce the incidence of damage to the concessions holder.

It is a further object of the present invention to have a concessions container that can made in a wide variety of novelty shapes and bear the title and logos of various current theatrical, entertainment and sporting events or advertising information.

It is a further object of the present invention to have a concessions container that can be replaced with another concessions container that displays appropriate information, shape or design regarding of various upcoming venue events or updated advertising information.

It is a yet another further object of the present invention to have a removable container portion bearing information and design regarding advertising or venue information that can be taken by the patron as a souvenir.

The foregoing and other objectives will become more apparent after consideration of the following detailed description taken, in conjunction with the accompanying drawings, in which a preferred form of this invention is illustrated.

BRIEF DESCRIPTION OF THE DRAWINGS

The novel features that are considered characteristic of the invention are set forth with particularity in the appended claims. The invention itself, however, both as to its structure and its operation together with the additional object and advantages thereof will best be understood from the following description of the preferred embodiment of the present invention when read in conjunction with the accompanying drawings wherein:

DESCRIPTION OF THE PREFERRED EMBODIMENT

Figure 1:
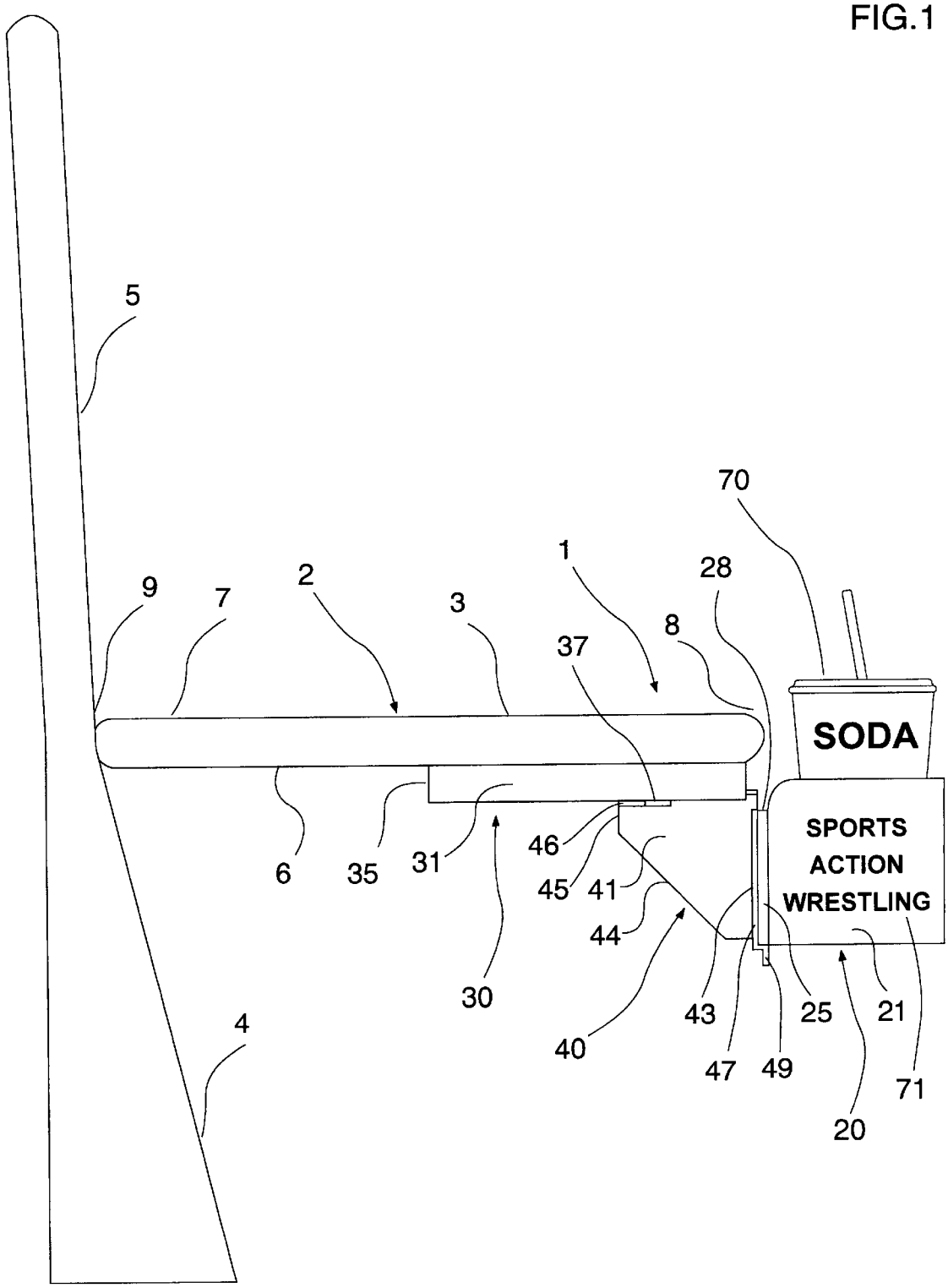
FIG. 1A side elevation view of the invention in the forward or operating position as applied to chair-type stadium seating.
Figure 2:
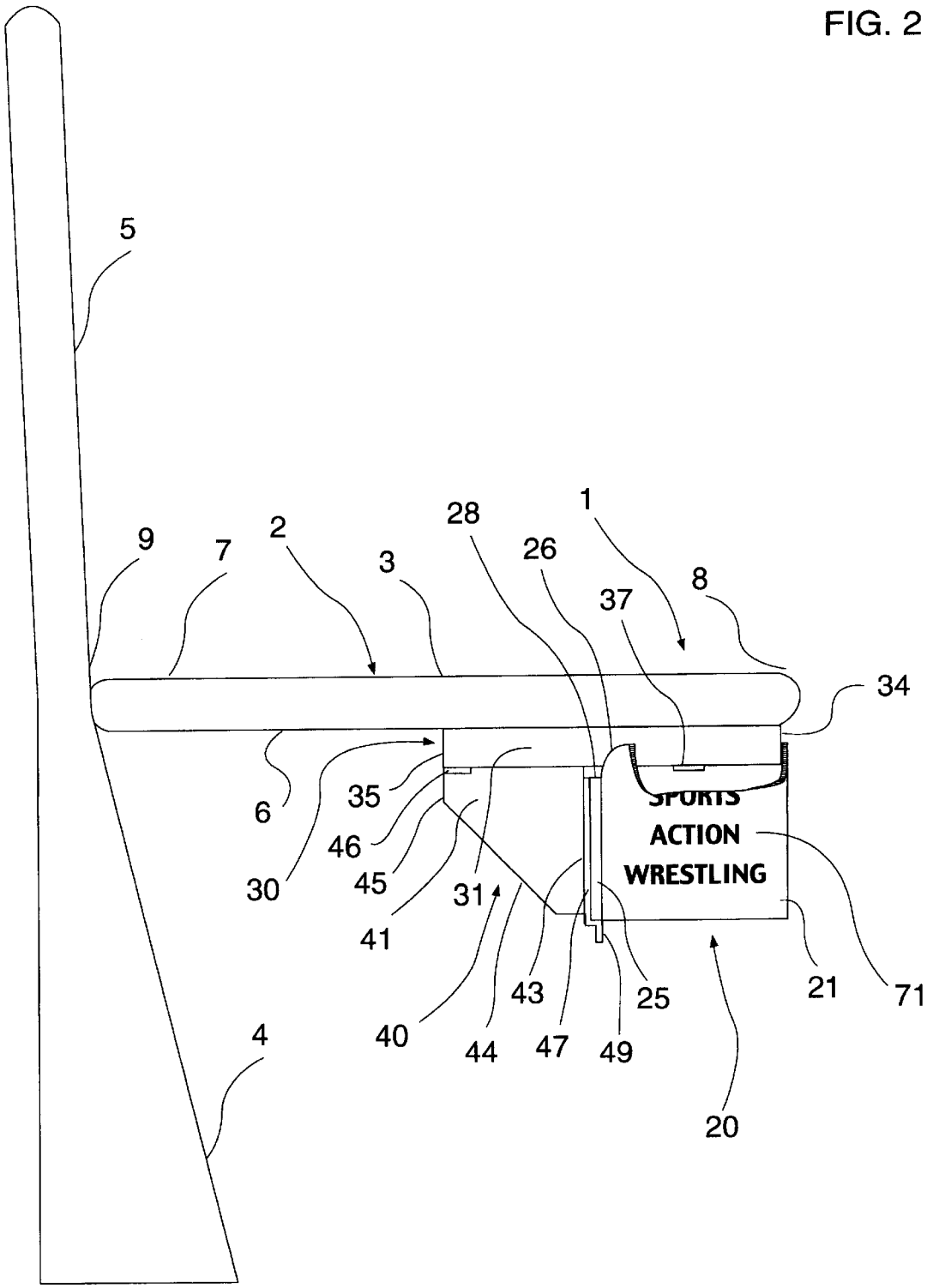
FIG. 2A side elevation partial cut away view of the invention in the stowed position as applied to chair-type stadium seating.
Figure 3:
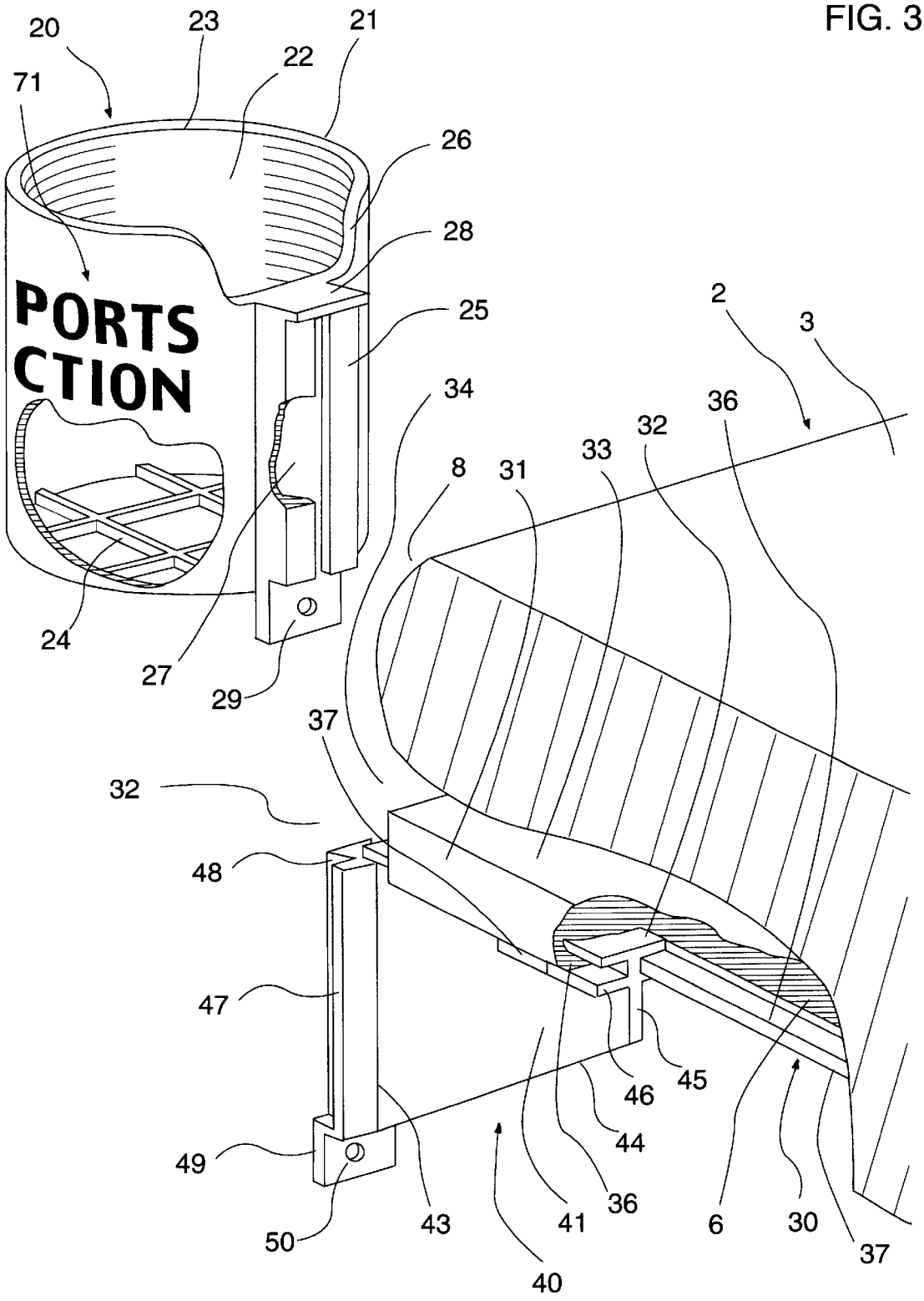
FIG. 3A perspective partial cutaway view of the container portion, the mounting device, and the attaching device.

Referring now to the Figures, wherein like numbers indicate like or corresponding parts through out several views, FIGURES. 1, 2 & 3 show the present invention 1 attached to the underside of a chair-type stadium seating 2 as commonly used in large capacity entertainment establishments such as theaters, stadiums, amphitheaters and sporting arenas.

Stadium seating, either the stadium chair-type seating 2 or a bench-type seating 10 is generally found to be permanently mounted within the entertainment facility's viewing area, usually grouped in rows to facilitate the placing and exiting of the patrons. The stadium chair-type seating 2 usually consists of a seat 3, a seat support 4, and a back 5.

The seat 3, which has an underside 6, a top 7 and a front 8, and a rear 9, can be permanently or pivotally attached at its rear 9 to either the back 5 or the seat support 4 or both. When not in use, the pivotally mounted version of the stadium chair-type seating 2 has its seat 3 folded upward against the back 5 to allow patrons greater passage when moving through the row where the stadium chair-type seating 2 is located.

The seat support 4 as shown is illustrative only since it can be of a variety of designs depending how the stadium seating is incorporated into the structure of the entertainment facility.

The invention 1 in its preferred embodiment comprises of a concessions container 20 for holding concessions 70 and displaying advertising information 71; a mounting bracket 40 to which the concessions container 20 is removabley affixed; and a seat attachment portion 30 to which the mounting bracket 40 is movably affixed. The seat attachment portion 30 is permanently attached to the underside 6 of the stadium seating so as to allow the movement of mounting bracket 40 to bring the concessions container 20 from an operating position in front 8 of seat 3 as shown in FIG. 1 to a stowed position underneath the seating 3 as shown in FIG. 2.

The invention 1 is attached to the stadium chair-type seating 2 using the attachment rail 31 that comprises of a back 32 which is permanently attached to the underside 6 of the seat 3; a pair of sides 33 descends down from the back 32; a front 34; and a rear 35. The attachment rail 31 is aligned with the longitudinal middle of the underside 6 of the seat 3 so that the front 34 is positioned near the bottom edge of the front 8 of the seat 3.

The each side 33 of the attachment rail 31 as it descends from the back 32 forms at their respective lower lengthwise edges an inwardly facing horizontal flange 36 that provides the sliding surface for the mounting bracket 40. This configuration provides the attachment rail 31 with a C-shaped cross-section. Descending from the bottom of each flange 36 is a peg 37, which is located near the front 34 of the attachment rail 31, that acts as a stop. The back 32 of the attachment rail 31 is permanently attached to the underside 6 of the seat 3 by the appropriate fastener or adhesive.

In the preferred embodiment, the attachment portion 30 is made by extrusion of a metal such as aluminum or by the injection molding of a polymer such a high impact light weight plastic.

The mounting bracket 40, which is movingly engaged to the seat attachment portion 30, is comprised of the rectangular plate 41 that has a horizontal top flange 42, a vertical front mounting edge 43, an ascendingly angled bottom edge 44, a vertical back edge 45 and two stop wings 46.

The horizontal top flange 42 with the rectangular plate 41 forms a T-shaped cross-sectional configuration. This T-shaped configuration allows the horizontal top flange 42 to mate and move within the C-shaped cross-sectional configured interior of the attachment rail 31 while at the same time allowing the rectangular plate 41 to pass between the edges of the horizontal flanges 36 of the attachment rail 31. The horizontal top flange 42 is inserted into the rear 35 of the attachment rail 31 to load the mounting bracket 40 onto the attachment rail 31. The bottom surfaces of the horizontal top flange 42 rides along the top surface of the horizontal flanges 36 of the attachment rail 31 allowing the mounting bracket 40 to slide along the length of the attachment rail 31.

The vertical front mounting edge 43 sports a vertical front flange 47 that forms a T-shaped cross-sectional configuration. This vertical front flange 47 does not run the full length of the vertical front mounting edge 43 in that vertical front flange 47 runs from the bottom to near the top of the vertical front mounting edge 43. The top portion of the vertical front mounting edge 43 is unflanged so to allow unhindered passage of that portion of the vertical front mounting edge 43 through the attachment rail 31 as the mounting bracket 40 rides along the attachment rail 31.

Running down the middle of the length of the vertical front flange 47 is a dovetail 48 which provides one half of the reversible attachment mechanism for the concessions container 20. A bottom 49 of the dovetail 48 emerges into a block to act as a stop to prevent the concessions container 20 from sliding down and off the dovetail 48.

An aperture 50 at the bottom 49 matches an aperture 29 in a securing rail 25 of the concessions container 20 so as to form a channel that pierces both the bottom 49 and the securing rail 25. A reversibly attached fastener such as a screw can be inserted through the channel made by the apertures 29 and 50 to prevent the concessions container 20 from being removed off the mounting bracket 40 if the concessions container 20 is not intended to be taken by the patron for a souvenir.

The ascendingly angled bottom edge 44 runs from the bottom of the front vertical mounting edge 43 to the bottom of the vertical back edge 45.

At the vertical back edge 45 of the mounting bracket 40 are two stop wings 46. There is one stop wing 46 projecting horizontally from each side of the rectangular plate 41. When the stop wings 46 come into contact with the vertically positioned pegs 37 from the attachment rail 31, the stop wings 50 will halt the forward movement of the mounting bracket 40 along the attachment rail 31 to prevent the mounting bracket 40 from coming off the front 34 of the attachment rail 31 and to insure the proper orientation of the mounting bracket 40 in forward operating position. In this forward orientation, the vertical mounting edge 43 is clear of the front 8 of the seat 3 and the front 34 of the attachment rail 31 to allow the concessions container 20 to be removably placed onto the mounting bracket 40 to allow the removable placement of concessions 70 and alike into the concessions container 20.

The concessions container 20 in the preferred embodiment has a generally cylindrically shaped body 21 having one end being an open top 23 and an other end being a semi-enclosed bottom 24 forming an interior 22 which can reversibly receive and hold concessions. A securing rail 25 attached to the exterior of the body 21 to provide reversible attachment for the concessions container 20 to the mounting bracket 40. The concessions container 20 is of suitable size to handle a wide variety of liquid and food containers for concessions 70 as well as a variety of other items such a entertainment programs or brochures and the alike.

However, to take full advantage of the advertising potential of the invention, the concessions container 20 could be made in various novelty shapes and sizes limited only by the effectiveness of its primary holding function; the need to provide a reversible attaching mechanism for attachment to the mounting bracket 40; and the need to fit underneath the seat 3. The concessions container is constructed so that its interior can accommodate a wide variety of concessions. The exterior of the body 21 could contain advertising 71 including sponsor information as well as be made in various novelty shapes and forms limited only by the requirements for holding capacity, attachment and stowage capability.

The semi-enclosed bottom 24, which is constructed as a grid or lattice work, supports the concessions 70 that are placed into the concessions container 20. The perforation of the grid or lattice work allows any spilt food or drink to drain out of the concessions container 20.

The open top 23 of the concessions container 20 has a wide bodied slot 26. At the center of the bottom edge of the wide-bodied slot 26 on the exterior 22 of the concessions container 20 is vertically attached the securing rail 25. The securing rail 25 has a general C-shaped cross-section configuration with the interior 27 of the securing rail 25 forming a dovetail notch which is opened at the lower end of the securing rail 25 and closed by a tab 28 at the top of the securing rail 25. The interior 27 of the securing rail 25 is fashioned to reversibly mate with the dovetail 48 located on front of the mounting bracket 40. The tab 28 of the securing rail 25 acts in conjunction with the bottom 49 of the vertical front mounting edge 43 of the mounting bracket 40, as a stop to prevent the concessions container 20 from slipping down and off the mounting bracket 40 once the interior 27 has fully engaged the dovetail 48.

Although, in the preferred embodiment of the invention 1, a dovetail attachment mechanism is shown to reversibly secure the concessions container 20 to the mounting bracket 40, there are a wide variety of other reversible attachment mechanisms known to the practitioner in the field that can be suitably adapted for this purpose. These mechanisms would include but not be limited to: pin/aperture, hook and cloth, slot and wedge, magnets and alike.

As a medium for presenting changable advertising to the patron, the present invention provides for a concessions container 20 of simple design that readily lends itself to inexpensive mass production using plastic mold injection techniques. The concessions container 20 could be made in various shapes, sizes, colors and designs as well as have advertising 71 such as print, photographs, pictures, graphics and the like for the display information to the patron relating to the present or forthcoming venues staged at the entertainment facility or for advertisement for various sponsors of the entertainment facility. The concessions container 20 could also be used as a removable souvenir for the patron to take as a memento of the event. Since the concessions container 20 is removable, the management of the entertainment facility could readily exchange concessions containers for new ones with new information as venues or sponsors change.

In operation, the mounting bracket 40 is loaded onto the attachment rail 31 by fitting the front of the horizontal top flange 42 into the rear 35 of the attachment rail 31 and moving the mounting bracket 40 into forward operating position that is by the front 8 of the seat 3 until stop wings 46 of the mounting bracket 40 come into contact with the pegs 37 of the attachment rail 31.

In this operation position, the dovetail 48 of the mounting bracket 40 is clear of the seat 3 and attachment rail 31 and is ready to receive the concessions container 20. The concessions container 20 is lowered onto the mounting bracket 40 so that the interior 27 of the securing rail 25 meets with and encompasses the dovetail 48 of the mounting bracket 40. The tab 28 of the securing rail 25 and the bottom 49 of the dovetail 48 prevent further downward movement of the concessions container 20 when it is properly situated on the mounting bracket 40. The concessions container 20, when the invention is operated in its forward position, is placed in front 8 of the seat 3 and oriented between the legs of the seated patron and is ready to receive concessions 70.

To bring the invention 1 into the stowed position underneath the seat 3, the patron removes any concessions 70 from the concessions container 20 and pushes the concessions container 20 and hence the mounting bracket 40, backwards along the attachment rail 31 into a stowed position underneath the seat 3. The wide-bodied slot 26 is of sufficient size to allow the concessions container 20 to pass unimpeded along the attachment rail 31 and pegs 37 until the front 34 of the attachment rail 31 comes into contact with the side of the interior 22 of the concessions container 20 that is opposite of the wide-bodied slot 26 thus limiting the rearward movement of the concessions container 20.

Figure 4:
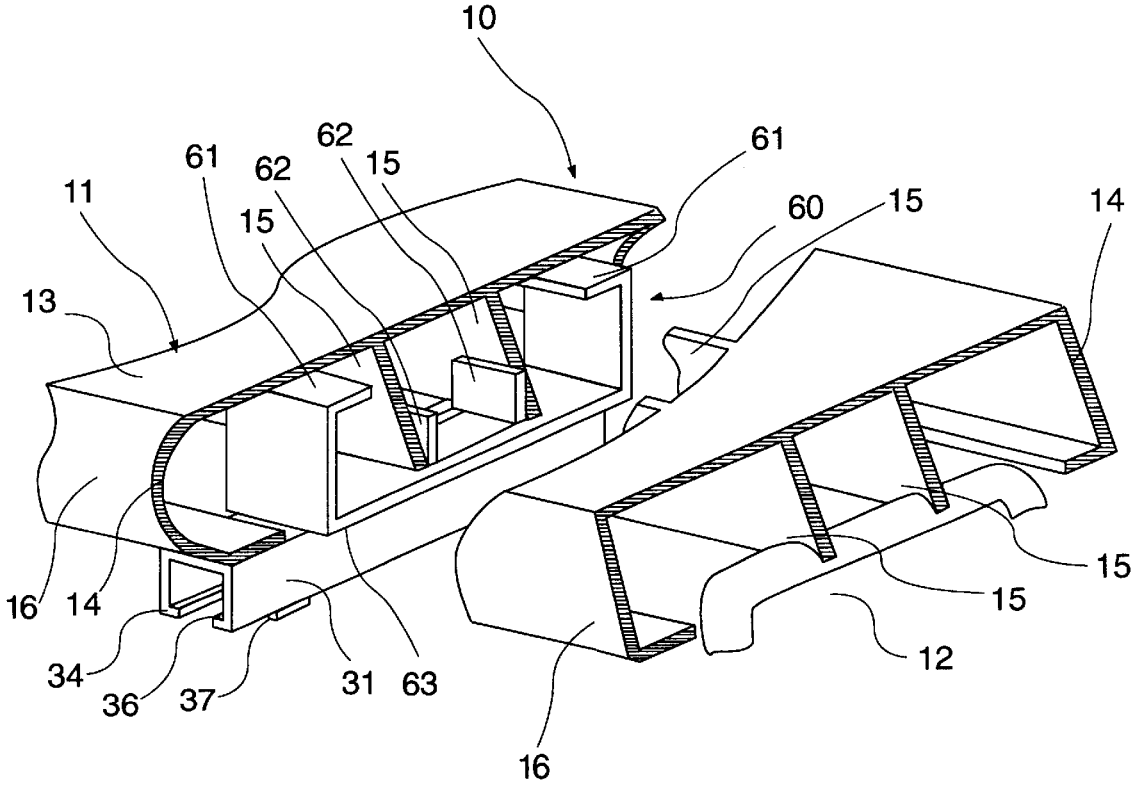
FIG. 4A perspective partial cutaway view of the invention attached to bench-type stadium seating.

As shown FIG. 4, the invention 1 uses a bench adapter 60 that it may be applied to bench-type seating 10. Bench-type seating 10 as commonly found in large entertainment facilities uses benches 11 with a bench support structure 12 that is attached to the structure of the entertainment facility. These benches 11 usually are made from extruded metal such as aluminum, or a injection molded plastic or formed fiberglass. The benches 11 have a generally C shaped cross-section configuration in which the back of the C forms the top surface 13 of the bench that patrons sit on. The underside 14 of the bench 10 has longitudinal struts 15 that run lengthwise along the middle of the underside 14. These longitudinal struts 15, along with flanged edges 16 that form the arms of the "C", act as stiffeners to provide structural strength for the bench. The longitudinal struts 15 also provide the mounting points for the bench support structure 12. Because of the presence of the flanged edges 16 and longitudinal struts 15 in the bench-type seating 10, an adapter 60 is permanently affixed the underside 14 of the bench 11 to provide a flat level mounting surface for the attachment of the invention 1.

The adapter 60 has a generally the shape of a "C" with and lateral "I" cut made in its middle. The arms of the "C" form the mounting flanges 61 that fasten the adapter 60 to the underside 14 by rivet or other appropriate fastener or attaching method known to practitioners in the field. The adapter 60 is affixed the lateral underside 14 of the bench-type seating 11.

The "I" cut forms two support tabs 62 that are bent upward to parallel the positioning of the mounting flanges 61. These support tabs 62 are cut and bent so as to be placed within and directly next to the interior walls of the longitudinal struts 15 when the adapter 60 is attached. In this position, the support tabs 62 then are able contribute to the rigidity of the adapter and to further limit back and forth movement of the adapter 60 when the invention 1 is being moved between stowed and operating positions.

The back of the C shape forms the back 63 of the adapter 60 which provides the flat surface for the attachment of the attachment rail 31. The mounting flanges 61 are of sufficient height so as to place the back 63 of the adapter 60 below and clear of longitudinal struts 15 and flanged edges 16 of the bench-type seating 10.

Figure 5:
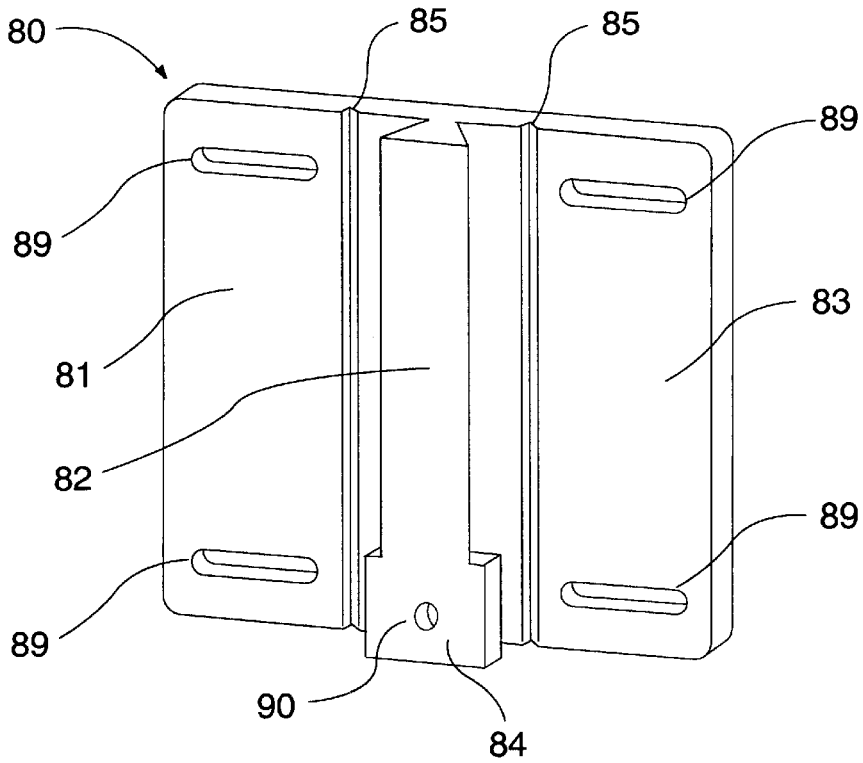
FIG. 5A perspective front view of the universal mount.
Figure 6:
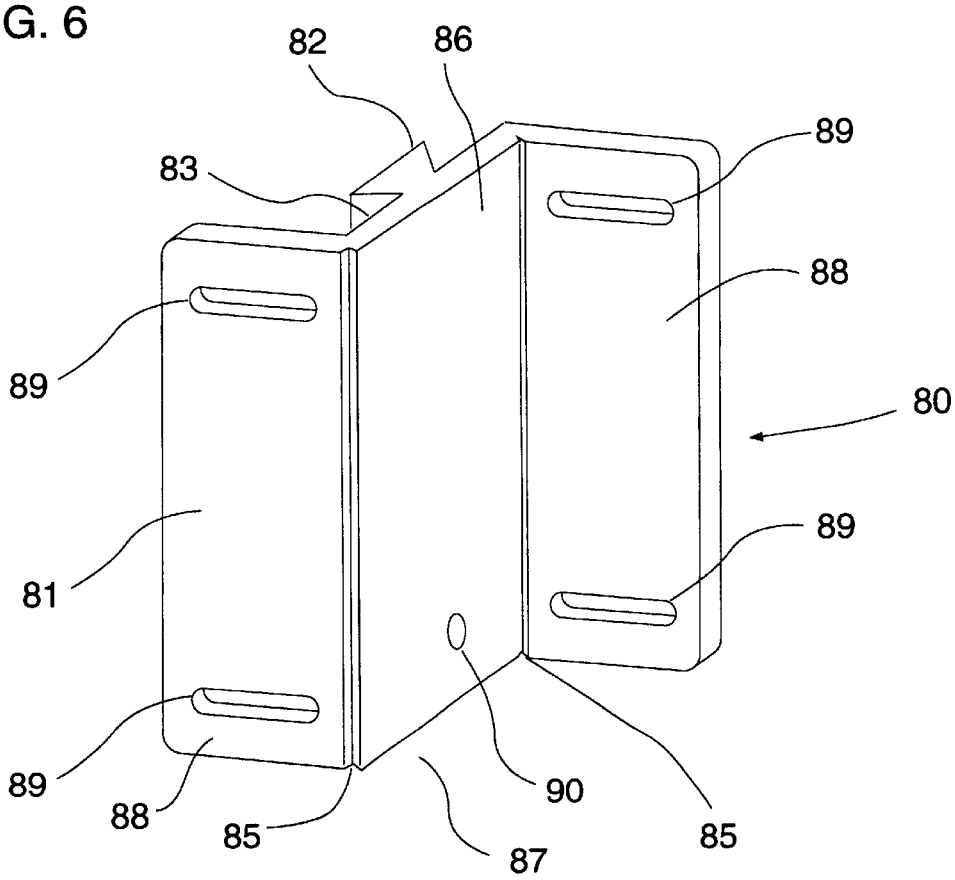
FIG. 6A perspective back view of the universal mount.

FIG. 5 and 6 show a universal adapter 80 which supplants the mounting bracket 40 and attachment rail 31 to allow the concessions container 20 to be reversibly mounted in a vertical position for a wide variety of applications. The universal adapter 80 comprises of a square plate 81 with a dovetail 82 vertically mounted on the middle of its front 83. A block 84 at the bottom of the dovetail 82 along with the tab 28 of the concessions container 20 prevents the concessions container 20 from slipping down and off of the dovetail 82 when the securing rail 25 of the concessions container 20 is slid onto the adapter dovetail 82. The backside 85 of the square plate 81 are two vertical channels 85 that divide the backside 86 into three equal panels, a middle panel 87 connected to two outer panels 88. The vertical channels 85 are cut wide and deep enough to allow outer panels 88 to flex either forward or back of the middle panel 87 that mounts the dovetail 82. This flexing of the panels allows the universal adapter 80 to be used on differently angled or curved surfaces, such as attaching the universal adapter 80 between the two backs 5 of stadium chair-type seating 2 that are adjacent to one another. The two outer panels 88 have apertures 89 to facilitate of the attachment of the universal adapter 80 by fasteners to the desired surface. An securing aperture 90 in block 84 matches the aperture 29 in the securing rail 25 of the concessions container 20 so as to form a channel that pierces both the block 84 and securing rail 25. A reversible attached fastener such as a screw can be inserted through the channel made by the security aperture 90 and aperture 29 to prevent the concessions container 20 from being removed off the universal adapter 80 if owner of the invention 1 does not intend that the concessions container 20 to be taken by the patron as a souvenir. The universal adapter 80 can also be attached by adhesive or other means known to practitioners in the field.

While the present invention has been described with respect to its presently preferred and variously considered alternative constructions and modifications, it is to be appreciated that still other constructions may suggest themselves to those of skill in the art. Accordingly, it is contemplated that the subject invention should be interpreted to include all those equivalent embodiments within the spirit and scope of the following claims.

What is claimed is:

1. A concessions holder attached to stadium type seating, such seating having a seat with a top and bottom, comprising:

a concessions container with a semi-enclosed bottom, a non-enclosed top, an interior and exterior, the interior removably receiving and holding concessions, the exterior having a vertically mounted securing rail, a mounting bracket including a plate with a horizontal top flange and a vertical top flange, the vertical top flange being removably received by the vertically mounted securing rail, and a seat attachment portion including an attachment rail permanently attached to the bottom of the seat, the attachment rail movably receiving the horizontal top flange of the mounting bracket, wherein the concessions container is removably attached to the mounting bracket, and is movable from a position in front of the seat to a position underneath the bottom of the seat as the mounting bracket is moved along the attachment rail.

2. The concessions holder of claim 1 wherein the body of the concessions container has novelty shapes and indicia displays to convey venue information.

3. The concessions holder of claim 1 wherein the body of the concessions container has a wide bodied slot cut into it at its non-enclosed top.

4. The concessions holder of claim 3 wherein the wide bodied slot is of sufficient size to allow passage of the attachment rail into the interior of the concessions container.

5. The concessions holder of claim 1 wherein the concessions container has stops that halt the mounting bracket at a forward operating position.

6. The concessions holder of claim 5 wherein the forward operating position presents the concessions container in front of the seat and clear of the attachment rail.

7. The concessions holder of claim 1 wherein the semi-enclosed bottom has sufficient perforations to allow drainage of any liquids spilt into the interior of the concessions container.

8. A concessions holder attached to stadium type seating commonly found in large capacity entertainment arenas, such seating having a bench with a top and a bottom, comprising:

a concessions container with a bottom and a non-enclosed top, an interior for removably holding concessions, and an exterior with a vertically mounted securing rail, a mounting bracket having;

a plate with a horizontal top flange, and a vertical front flange, being removably received by the vertically mounted securing rail of the concessions container; and a securing portion comprising an attachment rail, permanently attached to the bottom of the bench, for movably receiving the horizontal top flange, wherein the concessions container is movable from a position in front of the seat to a position underneath the bottom of the seat as the mounting bracket is moved along the attachment rail.

9. The concessions holder of claim 8 wherein the attachment rail is attached to an adapter permanently mounted to the bottom of the bench, the adapter providing the attachment rail with sufficient clearance to avoid any obstructions presented by the bottom of the bench.

10. The concessions holder of claim 8 wherein the body of the concessions container has novelty shapes and indicia displays to convey venue information.

11. The concessions holder of claim 8 wherein the concessions container has a wide bodied slot cut at its non-enclosed top.

12. The concessions holder of claim 11 wherein the wide bodied slot is of sufficient size to allow passage of the attachment rail.

13. The concessions holder of claim 8 wherein the concessions holder has stops that halt the mounting bracket at a forward operating position.

14. The concessions holder of claim 13 wherein the forward operating position presents the concessions container in front of the seat and clear of the attachment rail.

15. The concessions holder of claim 13 wherein the bottom is perforated to drain any concessions spilt into the interior of the concessions container.

* * * * *